United States Patent [19]

Dietz

[11] Patent Number: 5,040,492

[45] Date of Patent: Aug. 20, 1991

[54] FLUIDIZED BED COMBUSTION SYSTEM AND METHOD HAVING AN RECYCLE HEAT EXCHANGER WITH A NON-MECHANICAL SOLIDS CONTROL SYSTEM

[75] Inventor: David H. Dietz, Hampton, N.J.

[73] Assignee: Foster Wheeler Energy Corporation, Clinton, N.J.

[21] Appl. No.: 640,718

[22] Filed: Jan. 14, 1991

[51] Int. Cl.[5] ..... B09B 3/00; F22B 1/00

[52] U.S. Cl. ..... 122/4 D; 110/245; 165/104.16; 422/146

[58] Field of Search ..... 122/4 D; 165/104.16; 422/146; 110/245

[56] References Cited

U.S. PATENT DOCUMENTS

| | | | |
|---|---|---|---|
| 3,893,426 | 7/1975 | Bryers . | |
| 4,111,158 | 9/1978 | Reh et al. . | |
| 4,165,717 | 8/1979 | Reh et al. . | |
| 4,227,488 | 10/1980 | Stewart et al. . | |
| 4,338,283 | 7/1982 | Sakamoto et al. . | |
| 4,469,050 | 9/1984 | Korenberg . | |
| 4,594,967 | 6/1986 | Wolowodiuk . | |
| 4,617,877 | 10/1986 | Gamble . | |
| 4,665,864 | 5/1987 | Seshamani et al. . | |
| 4,682,567 | 7/1987 | Garcia-Mallol et al. . | |
| 4,686,939 | 8/1987 | Stromberg . | |
| 4,694,758 | 9/1987 | Gorzegno et al. . | |
| 4,704,084 | 11/1987 | Liu et al. . | |
| 4,709,662 | 12/1987 | Rawdon | 122/4 D |
| 4,716,856 | 1/1988 | Beisswenger et al. | 122/4 D |
| 4,761,131 | 8/1988 | Abdulally . | |
| 4,813,479 | 3/1989 | Wahlgren | 165/104.16 |
| 4,856,460 | 8/1989 | Wied et al. . | |
| 4,896,717 | 1/1990 | Campbell, Jr. et al. . | |
| 4,947,804 | 8/1990 | Abdulally | 122/4 D |
| 4,969,930 | 11/1990 | Arpalahti . | |

*Primary Examiner*—Edward G. Favors
*Attorney, Agent, or Firm*—Marvin A. Naigur

[57] ABSTRACT

A fluidized bed combustion system and method in which a recycle heat exchange section is located within an enclosure housing the furnace section of the combustion system. The flue gases and entrained solids from a fluidized bed in the furnace section are separated and the flue gases are passed to a heat recovery section and the separated particulate material to the heat exchange section. The heat exchange section includes a bypass chamber for permitting the separated solids to pass directly from the separator to the furnace section. A heat exchange chamber is provided in the recycle heat exchange section which receives the separated materials from the bypass chamber and transfers heat from the separated material to a fluid flow circuit. The separated material in the heat exchange chamber is then passed back to the furnace section.

12 Claims, 4 Drawing Sheets

FLUIDIZED BED COMBUSTION SYSTEM AND METHOD HAVING AN RECYCLE HEAT EXCHANGER WITH A NON-MECHANICAL SOLIDS CONTROL SYSTEM

BACKGROUND OF THE INVENTION

This invention relates to a fluidized bed combustion system and a method of operating same and, more particularly, to such a system and method in which a recycle heat exchanger is formed integrally with the furnace section of the system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The external solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence times reduces the adsorbent and fuel consumption.

In the operation of these types of fluidized beds, and, more particularly, those of the circulating type, there are several important considerations. For example, the flue gases and entrained solids must be maintained in the furnace section at a particular temperature (usually approximately 1600° F.) consistent with proper sulfur capture by the adsorbent. As a result, the maximum heat capacity (head) of the flue gases passed to the heat recovery area and the maximum heat capacity of the separated solids recycled through the cyclone and to the furnace section are limited by this temperature. In a cycle requiring only superheat duty and no reheat duty, the heat content of the flue gases at the furnace section outlet is usually sufficient to provide the necessary heat for use in the heat recovery area of the steam generator downstream of the separator. Therefore, the heat content of the recycled solids is not needed.

However, in a steam generator using a circulating fluidized bed with sulfur capture and a cycle that requires reheat duty as well as superheater duty, the existing heat available in the flue gases at the furnace section outlet is not sufficient. At the same time, heat in the furnace cyclone recycle loop is in excess of the steam generator duty requirements. For such a cycle, the design must be such that the heat in the recycled solids is utilized before the solids are reintroduced to the furnace section.

To provide this extra heat capacity, a recycle heat exchanger is sometimes located between the separator solids outlet and the fluidized bed of the furnace section. The recycle heat exchanger includes heat exchange surfaces and receives the separated solids from the separator and functions to transfer heat from the solids to the heat exchange surfaces at relatively high heat transfer rates before the solids are reintroduced to the furnace section. The heat from the heat exchange surfaces is then transferred to cooling circuits to supply reheat and/or superheat duty.

The recycle heat exchanger usually includes a bypass channel for permitting direct flow of the recycled solids from the recycle heat exchanger inlet to the furnace section in order to avoid contacting the solids with the heat exchange surfaces in the heat exchanger during start-up or low load conditions. However, this type of arrangement usually requires mechanical valves, or the like, for selectively controlling the flow of the solids from the inlet, through the bypass channel and to the furnace section; or from the inlet, through an area containing the heat exchange surfaces and to the furnace section. These mechanical valves are large, expensive and require periodic replacement which adds to the cost of the system.

SUMMARY OF THE INVENTION

It is an object of the present invention to provide a fluidized bed combustion system and method which utilizes a recycle heat exchanger disposed integrally with the furnace section of the combustion system.

It is a further object of the present invention to provide a system and method of the above type in which heat exchange surfaces are provided in the recycle heat exchanger to remove heat from the separated solids to provide additional heat to a fluid circuit associated with the system.

It is a still further object of the present invention to provide a system and method of the above type in which the recycle heat exchanger includes a direct bypass chamber for routing the separated solids directly to the furnace section without passing over any heat exchange surfaces during start-up, shut-down, unit trip, and low load conditions.

It is a still further object of the present invention to provide a system and method of the above type in which a non-mechanical control system is provided for selectively passing the separated solids through the bypass chamber or over the heat exchange surfaces in the recycle heat exchanger.

Toward the fulfillment of these and other objects, the system of the present invention includes a recycle heat exchanger located adjacent the furnace section of the system. The flue gases and entrained particulate materials from the fluidized bed in the furnace section are separated, the flue gases are passed to a heat recovery area and the separated solids are passed to the recycle heat exchanger for transferring heat from the solids to fluid passing through the system. Heat exchange surfaces are provided in the heat exchanger for removing heat from the solids, and a bypass passage is provided which is connected directly to a J-valve which receives the separated solids from the separator so that the solids pass through the bypass passage during start-up and low load conditions. A non-mechanical control system is provided utilizing fluidizing nozzles of different heights to selectively control the flow of the separated solids through the bypass channel to the furnace or from the bypass channel, over the heat exchange surfaces and to the furnace.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
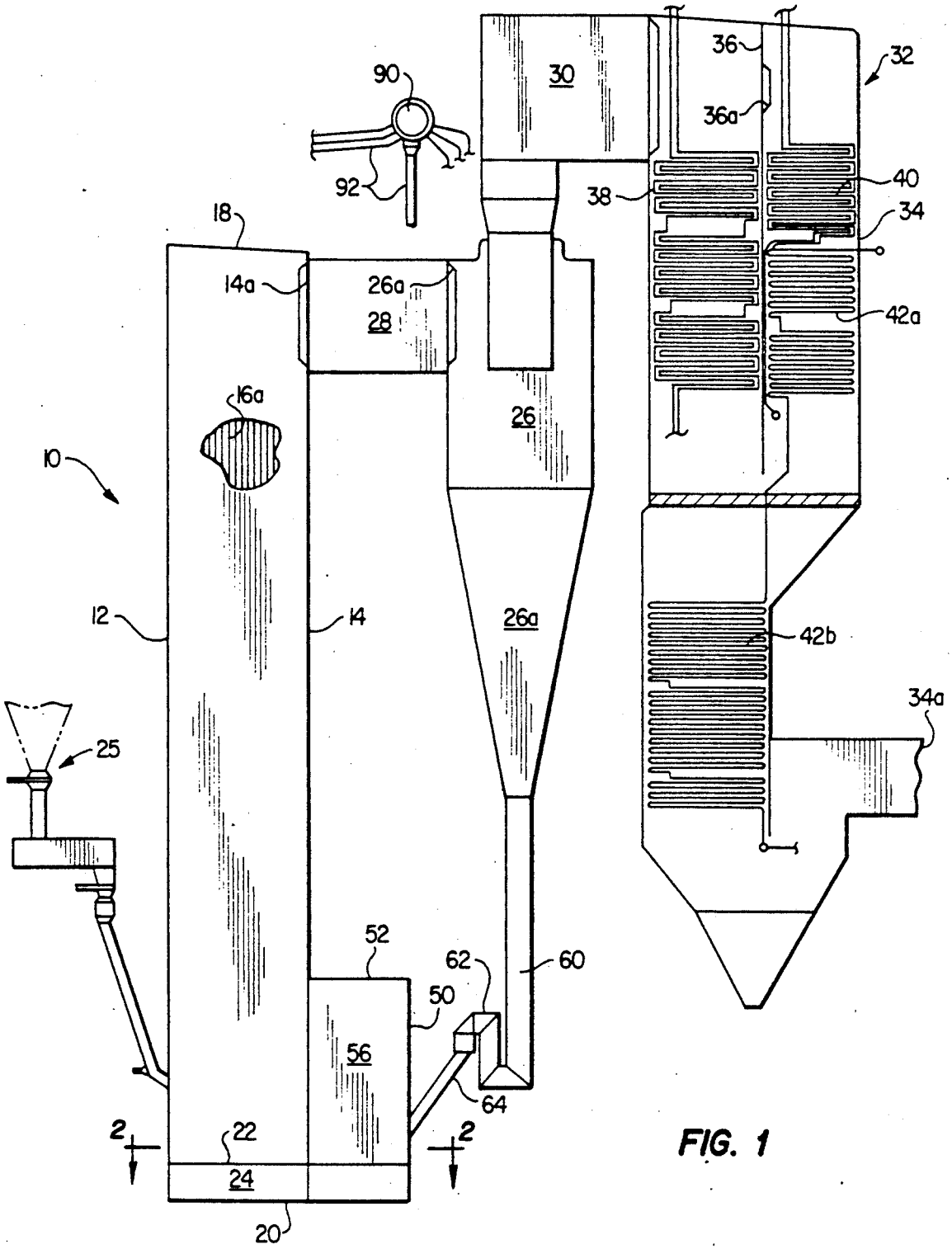
FIG. 1 is a schematic representation depicting the system of the present invention.

FIG. 1 of the drawings depicts the fluidized bed combustion system of the present invention used for the generation of steam. The system includes an upright water-cooled enclosure, referred to in general by the reference numeral 10, having a front wall 12, a rear wall 14 and two sidewalls one of which is shown by the reference number 16*a*. The upper portion of the enclosure 10 is enclosed by a roof 18 and the lower portion includes a floor 20.

A plate 22 extends across the lower portion of the enclosure 10 and is spaced from the floor 18 to define an air plenum 24 which is adapted to receive air from an external source (not shown) and selectively distribute the air through perforations in the plate 2 and to nozzles (not shown in FIG. 1) mounted on the plate as will be described.

A coal feeder system, shown in general by the reference numeral 25, is provided adjacent the front wall 12 for introducing particulate material containing fuel into the enclosure 10. The particulate material is fluidized by the air from the plenum 24 as it passes upwardly through the plate 22. This air promotes the combustion of the fuel and the resulting mixture of combustion gases and the air (hereinafter termed "flue gases") rises in the enclosure by forced convection and entrains a portion of the solids to form a column of decreasing solids density in the upright enclosure 10 to a given elevation, above which the density remains substantially constant. It is understood that an absorbent, such as limestone, in particle form can also be introduced into the enclosure by a separate feeder system or by a duct connected to the feeder system 25.

A cyclone separator 26 extends adjacent the enclosure 10 and is connected thereto via a duct 28 extending from an outlet 14*a* provided in the rear wall 14 of the enclosure 10 to an inlet 26*a* provided through the separator wall. Although reference is made to one separator 26, it is understood that one or more additional separators (not shown) can be disposed behind the separator 26.

The separator 26 receives the flue gases and the entrained particle material from the enclosure 10 in a manner to be described and operates in a conventional manner to disengage the particulate material from the flue gases due to the centrifugal forces created in the separator. The separated flue gases, which are substantially free of solids, pass, via a duct 30 located immediately above the separator 26, into a heat recovery section 32, via an inlet 32*a* provided through a wall thereof.

The heat recovery section 32 includes an enclosure 34 divided by a vertical partition 36 into a first passage which houses a reheater 38, and a second passage which houses a primary superheater 40. An economizer is provided and has an upper section 42*a* located in the above-mentioned second passage and a lower section 42*b* in the lower portion of the heat recovery section 32. An opening 36*a* is provided in the upper portion of the partition 36 to permit a portion of the gases to flow into the passage containing the superheater 40 and the economizer sections 42*a* and 42*b*. The reheater 38, the superheater 40 and the economizer sections 42*a* and 42*b* are all formed by a plurality of heat exchange tubes extending in the path of the gases as they pass through the enclosure 34. After passing across the reheater 36, the superheater 40 and the economizer sections 42*a* and 42*b* in the two parallel passes, the gases exit the enclosure 34 through an outlet 34*a*.

As shown in FIG. 1, the floor 20 the plate 22 and the sidewalls 16*a* and 16*b* extend past the rear wall 14, and a vertically-extending partition 50 extends upwardly from the floor 18 and parallel to the rear wall 14. A roof 52 extends from the partition 50 to the rear wall 14. The front wall 12 and the rear wall 14 define a furnace section 54, and the rear wall 14 and the partition 50 define a recycle heat exchange section 56.

The floor 20, the plate 22, and therefore the plennum 24 extend underneath the heat exchange section 5 for introducing air to the latter section in a manner to be described.

The lower portion of the separator 26 includes a hopper 26*a* which is connected to a dip leg 60 connected to an inlet "J" valve, shown in general by the reference numeral 62. An inlet conduit 64 connects the outlet of the J-valve 62 to the heat exchange section 56 to transfer the separated solids from the separator 26 to the latter section. The J-valve 62 functions in a conventional manner to prevent back-flow of solids from the furnace section 54 and the heat exchange section 56 to the separator 26.

Figure 2:
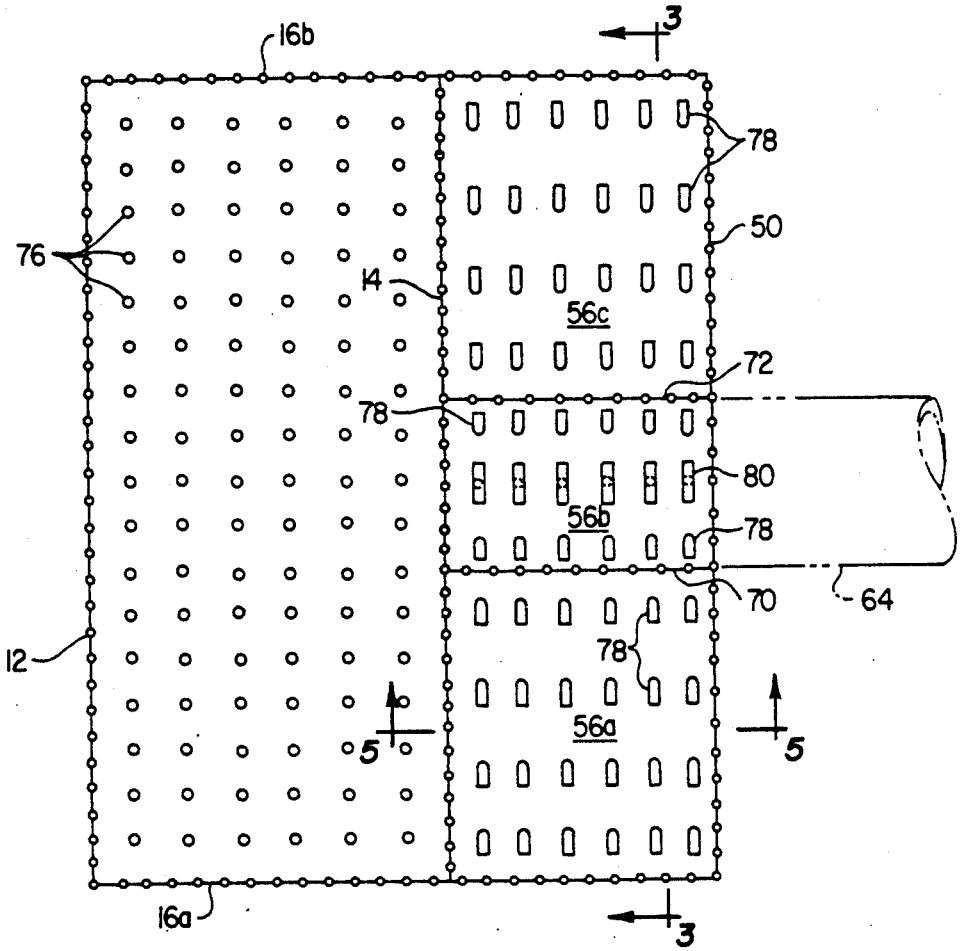
FIG. 2 is a partial cross-section, partial schematic view taken along the line 2—2 of FIG. 1.
Figure 3:
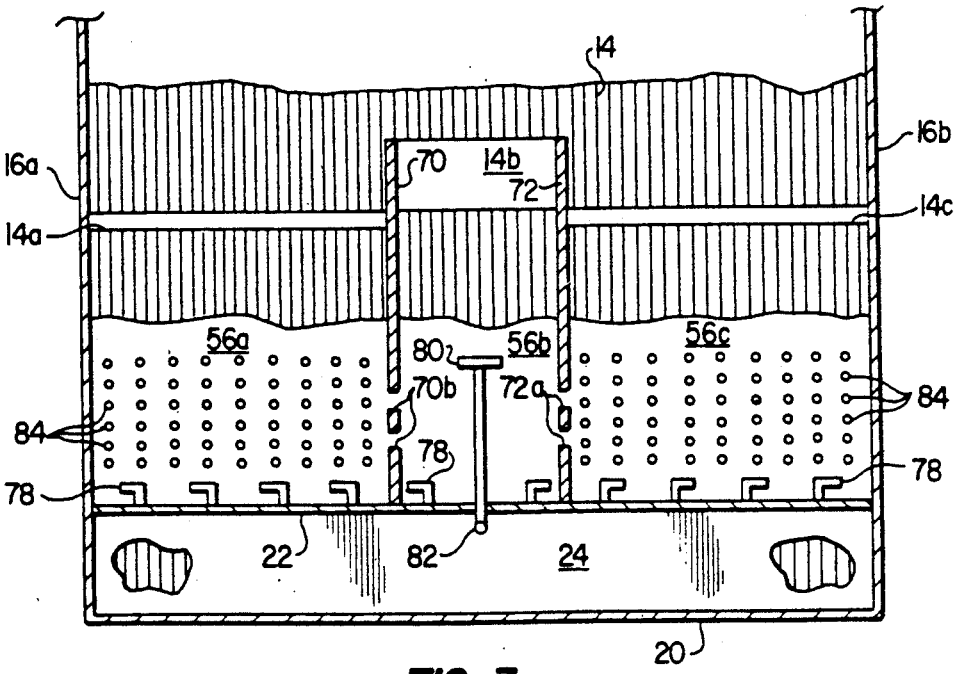
FIG. 3 is a cross-sectional view taken along the line 3—3 of FIG. 2.

FIGS. 2 and 3 depict the other sidewall 16*b* of the enclosure 10 as well as a pair of transverse spaced partitions 70 and 72 extending between the rear wall 14 and the partition 50. As shown in FIG. 3, the partitions 70 and 72 extend for a height less than the walls forming the heat exchange section 56.

Figure 4:
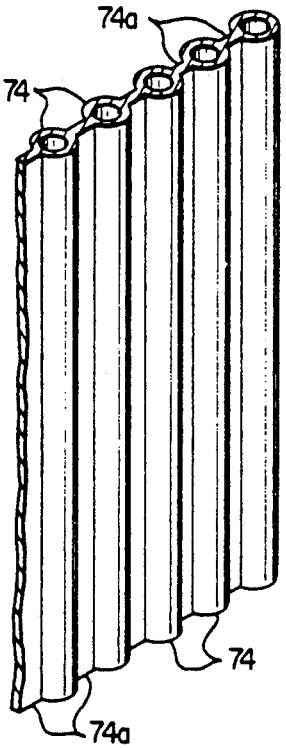
FIG. 4 is a partial, enlarged perspective view of a portion of a wall of the enclosure of the system of FIG. 1.

The front wall 12, the rear wall 14, the sidewalls 16*a* and 16*b* and the partitions 50 and 70, as well as the walls defining the heat recovery enclosure 10 are formed in a manner depicted in FIG. 4. As shown, each wall is formed by a plurality of spaced tubes 74 having continuous fins 74*a* extending from diametrically opposed portion thereof to form a gas-tight membrane.

Referring to FIGS. 2 and 3, the partitions 70 and 72 divide the lower portion of the heat exchange section into three compartments 56*a*, 56*b* and 56*c*. The inlet conduit 64 registers with an opening in the partition 50 communicating with the compartment 56*b*.

A plurality of rows of air distributors, or nozzles, 78 extend through the plate 22 in the furnace section 54 for distributing air from the plenum 24 upwardly into the furnace section. A plurality of rows of nozzles 78 extend through the perforations in the plate 22 in the heat exchange section 56. Each nozzle 78 consists of a central portion extending through the perforation and a horizontal discharge portion registering with the vertical portion. As shown in FIGS. 2 and 3, the nozzles 78 in the compartments 56*a* and 56*c* are disposed in parallel rows with their discharge portions facing towards the sidewalls 16*a* and 16*b*, respectively.

Two parallel rows of nozzles 78 are provided in the compartment 56*b* with their discharge portions facing towards the partitions 70 and 72, respectively. A single row of nozzles 80 are also located in the compartment 56*b* and extend between the two rows of nozzles 78. The nozzles 80 are taller than the nozzles 78 for reasons to be explained. A manifold 82 is located in the plenum 24 and is connected to the nozzles 80 for supplying air to the nozzles independently of the flow of air from the plenum 24, through the plate 22 and to the nozzles 76 and 78.

Figure 5:
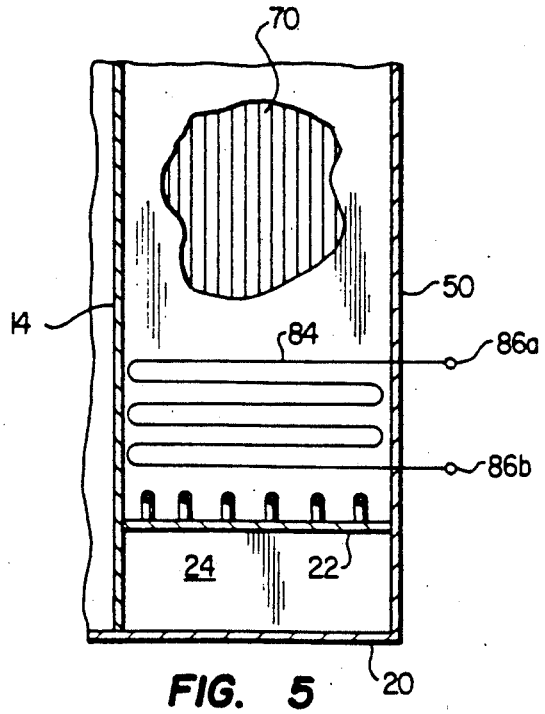
FIG. 5 is an enlarged sectional view taken along the line 4—4 of FIG. 2.

As shown in FIGS. 3 and 5, a bank of heat exchange tubes 84 are disposed in each of the compartments 56*a* and 56*c*. The tubes 84 extend between headers 86*a* and 86*b* (FIG. 5) for circulating fluid through the tubes.

Three horizontally spaced elongated openings 14*a*, 14*b* and 14*c* (FIG. 3) are provided through a portion of those portions of the wall 14 defining the compartments 56*a*, 56*b* and 56*c*, respectively. The opening 14*b* extends at an elevation higher than the openings 14*a* and 14*c* for reasons to be described. The openings are shown schematically in FIG. 3 for the convenience of presentation, it being understood that they actually are formed by cutting away the fins 74*a*, or bending the tubes 74 out of the plane of the wall 14, in a conventional manner. Also, a plurality of openings 70*a* and 72*a* (FIG. 3) are formed in the lower portions of the partitions 70 and 72, respectively, for reasons to be described.

A steam drum 90 (FIG. 1) is located above the enclosure 10 and, although not shown in the drawings, it is understood that a plurality of headers are disposed at the ends of the various walls described above. As shown in general by the reference numeral 92, a plurality of downcomers, pipes, etc. are utilized to establish a steam and water flow circuit through these headers, the steam drum 90 and the tubes 74 forming the aforementioned water tube walls, with connecting feeders, risers, headers being provided as necessary. The boundary walls of the cyclone separator 26, the heat exchanger tubes 84 and the tubes forming the reheater 38 and the superheater 40 are thus steam cooled while the economizer portions 42*a* and 42*b* receive feed water and discharge it to the steam drum 82. Thus, water is passed, in a predetermined sequence through this flow circuitry, including the downcomers and pipes 92, to convert the water to steam and heat the steam by the heat generated by combustion of the particulate fuel material in the furnace section 54.

In operation, particulate fuel material and a sorbent material (hereinafter referred to as "solids") are introduced into the furnace section 54 through the feeder system 25. Alternately, sorbent may also be introduced independently through openings through one or more of the furnace walls 12, 14, 16*a* and 16*b*. Air from an external source is introduced at a sufficient pressure into that portion of the plenum 24 extending below the furnace section 54 and the air passes through the nozzles 76 disposed in the furnace section 54 at a sufficient quantity and velocity to fluidize the solids in the latter section.

A lightoff burner (not shown), or the like, is provided to ignite the fuel material in the solids, and thereafter the fuel material is self-combusted by the heat in the furnace section 54. The mixture of air and gaseous products of combustion (hereinafter referred to as "flue gases") passes upwardly through the furnace section 54 and entrains, or elutriates, a majority of the solids. The quantity of the air introduced, via the air plenum 24, through the nozzles 76 and into the interior of the furnace section 54 is established in accordance with the size of the solids so that a circulating fluidized bed is formed, i.e. the solids are fluidized to an extent that substantial entrainment or elutriation thereof is achieved. Thus the flue gases passing into the upper portion of the furnace section 54 are substantially saturated with the solids and the arrangement is such that the density of the bed is relatively high in the lower portion of the furnace section 54, decreases with height throughout the length of this furnace section and is substantially constant and relatively low in the upper portion of the furnace section.

The saturated flue gases in the upper portion of the furnace section 54 exit into the duct 28 and pass into the cyclone separator 26. In the separator 26, the solids are separated from the flue gases and the former passes from the separators through the dipleg 60 and are injected, via the J-valve 62 and the conduit 64 into the heat exchange section 56. The cleaned flue gases from the separator 26 exit, via the duct 30, and pass to the heat recovery section 32 for passage through the enclosure 34 and across the reheater 38, the superheater 40, and the economizer sections 42*a* and 42*b*, before exiting through the outlet 34*a* to external equipment.

With reference to FIGS. 2 and 3, the separated solids from the conduit 64 enter the compartment 56*b* of the heat exchange section 56. Assuming normal operation, fluidizing air is introduced, via the plenum 24, to the nozzles 78 in the compartments 56*a*, 56*b* and 56*c* of the heat exchange section 56, while the air flow to the manifold 82, and therefore to the nozzles 80, is turned off. Since the two rows of nozzles 78 in the compartment 56*b* are directed towards the walls 70 and 72, respectively, the solids pass from the compartment 56*b* into the compartments 56*a* and 56*c*, respectively. The solids mix and build up in the compartments 56*a* and 56*c* and thus give up heat to the water/steam in the tubes 84 in the latter compartments. The cooled solids then pass through the openings 14*a* and 14*c* in the wall 14 and back to the furnace section 54.

Feed water is introduced to and circulated through the flow circuit described above including the water wall tubes 74 and the steam drum 90, in a predetermined sequence to convert the feed water to steam and to reheat and superheat the steam. To this end, the heat removed from the solids in the heat exchange section 56 can be used to provide reheat and/or full or partial superheat. For example, the banks of tubes 84 in the compartments 56*a* and 56*c*, respectively, can function to provide different stages of heating such as primary, intermediate and finishing superheating.

Since, during the above operation, there is no air introduced into the nozzles 80 in the compartment 56*b* very little, if any, flow of solids occurs through the latter passage.

During initial start up and low load conditions the fluidizing air flow to the plenum 24 is turned off and the air flow to the manifold 82, and therefore to the nozzles 80, is turned on. As a result, the volume of solids in the compartments 56*a* and 56*c* slump and therefore seal each volume from further flow. Thus, the solids from the conduit 64 pass directly through the compartment 56*b* and, after building up to the level of the opening 14*b*, pass through the latter opening into the furnace section 54. Since the compartment 56*b* does not contain heat exchanger tubes, start up and low load operation can be achieved without exposing the banks of tubes 84 to the hot recirculating solids.

It is understood that a drain pipe, or the like, may be provided on the plate 22 as needed for discharging spent solids from the furnace section 54 and the heat exchange section 56 as needed.

The system of the present invention has several advantages. For example, heat is removed from the separated solids exiting from the separator 26 before they are reintroduced to the furnace section 54 without reducing the temperature of the separated flue gases. Also, the separated gases are at a sufficient temperature to provide significant heating of the system fluid while the recycle heat exchanger can function to provide additional heating. Further, the recycled solids can be passed directly from the J-valve 62 to the furnace section 54 during start-up or low load conditions prior to establishing adequate cooling steam flow to the heat exchange tubes 84. Also, the heat exchanger section 56 is formed integrally with the furnace section 54 and operates at the same saturation temperature of the cooling fluid, thus permitting the all welded boundary wall construction as shown in FIG. 4. Also, the flow of separated solids back to the furnace section 54 can be achieved precisely and quickly by controlling the flow of fluidizing air from the plenum 24. Further, a relatively large space is provided in the compartments 56*a* and 56*c* for accommodating the heat exchange tubes.

Figure 6:
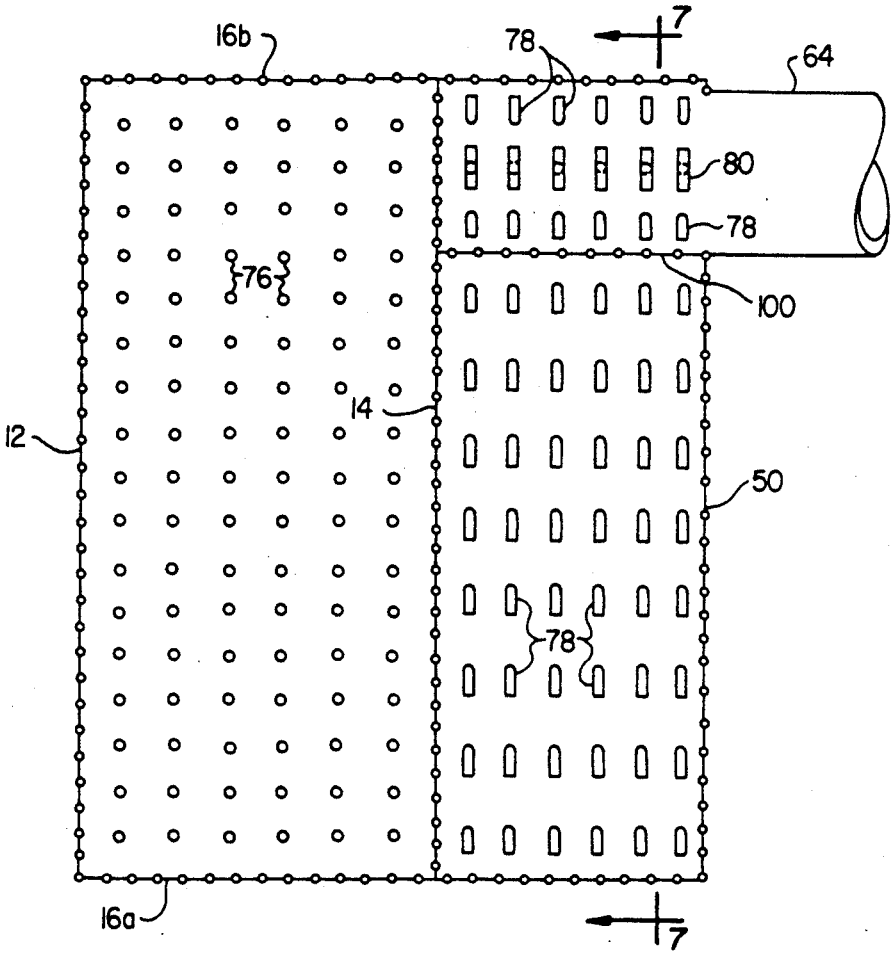
FIG. 6 and 7 are views similar to FIGS. 2 and 3, respectively, but depicting an alternate embodiment of the present invention.
Figure 7:
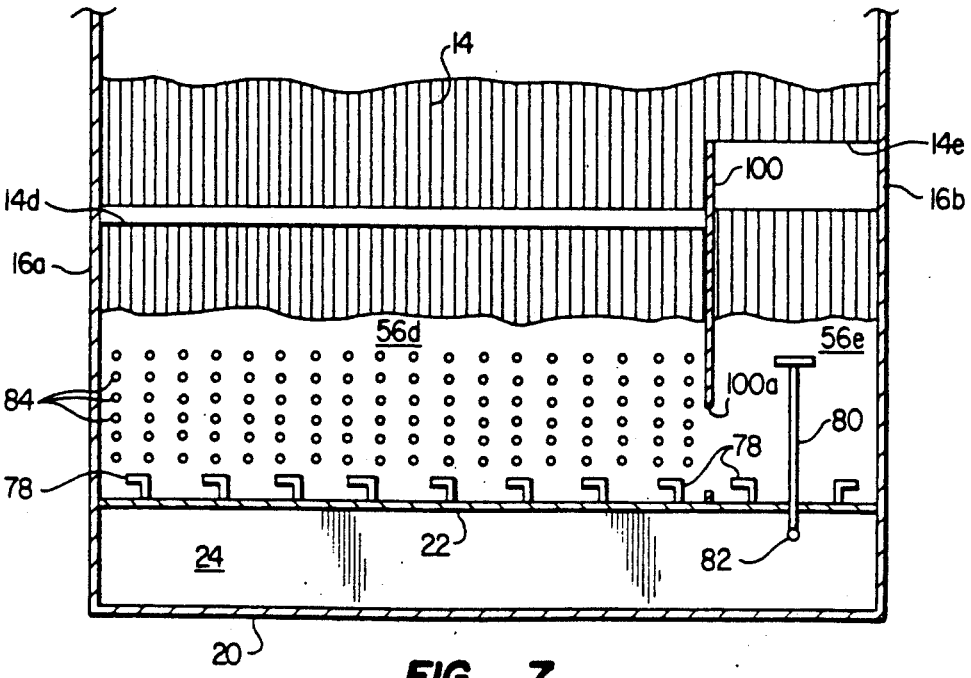

The embodiment of FIGS. 6 and 7 is similar to the previous embodiment and includes identical components which are given the same reference numerals. According to the embodiment of FIGS. 6 and 7, a single transverse partition 100 is provided in the heat exchange section 56 to divide it into compartments 56*d* and 56*e*. An opening 100*a* (FIG. 7) is provided through the lower portion of the partition 100 to permit the separated solids to flow from the compartment 56*e* to the compartment 56*d*, as will be described.

A plurality of rows of nozzles 78 are provided in the compartment 56*d* all of which face towards the sidewall 16*a*. Two rows of nozzles 78 are provided in the compartment 56*e* which face towards the partition 100 and the sidewall 16*b*, respectively. A row of nozzles 80 extend between the two rows of nozzles 78 in the compartment 56*e*, and the nozzles 80 are connected to the manifold 82 (FIG. 7) disposed in the plenum 24. A plurality of heat exchange tubes 84 are provided in the compartment 56*d* and the inlet conduit 64 extends through an opening in the wall 50 and registers with the compartment 56*e*. An opening 14*d* is formed through the wall 14 which connects the compartment 56*d* to the furnace section 54. An opening 14*e* is formed through the wall 14 which connects the compartment 56*e* to the furnace section 54 and which is located at an higher elevation than the opening 14*d*. The embodiment of FIGS. 6 and 7 as otherwise identical to that of the embodiment of FIGS. 1–5.

The operation of the embodiment of FIGS. 6 and 7 is similar to that of the embodiment of FIGS. 1–5. Thus in normal operations, air flow to the nozzles 78 in the compartments 56*d* and 56*e* is turned on, while the air flow to the nozzles 80 in the compartment 56*e* is turned off. The furnace section 54, the separator 26 and the heat recovery section 32 operate as described above. Thus, separated solids from the separator 26 are directed, via the conduit 64, into the compartment 56*e*. The row of nozzles 78 located adjacent the partition 100 direct the solids towards and through the opening 100*a* in the partition 100, into the compartment 56*d* and across the heat exchange tubes 84 for removing heat from the solids. As the level of cooled solids in the compartment 56*d* rises, the solids pass into the furnace section 54, via the opening 14*c*.

During start-up and low load conditions, the nozzles 78 are turned off and the nozzles 80 are turned on. As a result, very little, if any, flow of solids occurs from the compartment 56*e* to the compartment 56*d*. The solids thus build up in the compartment 56*e* and pass into the furnace section 54, via the opening 14*d*.

It is understood that several variations may be made in both of foregoing embodiments without departing from the scope of the present invention. For example, the heat removed from the solids in the heat exchange section 56 can be used for heating the system fluid in the furnace section or the economizer, etc. and other types of beds may be utilized in the furnace, such as a circulating transport mode bed with constant density through its entire height. Further, a series heat recovery arrangement can be provided with superheat, reheat and/or economizer surface, or any combination thereto. Also, the number and/or location of the bypass channels in the recycle heat exchanger can be varied and the number and size of separators used can be varied in accordance with the capacity of the steam generator and economic considerations.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising means defining a furnace section; means forming a fluidized bed in said furnace section; a separating section for receiving a mixture of flue gases and entrained particulate material from said fluidized bed and separating said entrained particulate material from said flue gases; a heat recovery section for receiving said separated flue gases; and a recycle heat exchanger disposed adjacent said furnace section for receiving said separated particulate material; said recycle heat exchanger comprising a housing having a bypass compartment for receiving said separated solids, a heat exchange compartment adjacent said bypass compartment, heat exchange means disposed in said heat exchange compartment, means for connecting said bypass compartment to said furnace section, means for connecting said bypass compartment to said heat exchange compartment, a plurality of air nozzles disposed in said bypass compartment and said heat exchange compartment, and means for selectively introducing air to said nozzles to control the flow of solids from said bypass compartment to said heat exchange compartment and from said bypass compartment to said furnace section.

2. The system of claim 1 further comprising means for connecting said heat exchange compartment to said furnace section to permit the flow of said solids from said heat exchange compartment to said furnace section.

3. The system of claim 1 further comprising a partition disposed in said housing for defining, with the walls of said housing, said bypass compartment and said heat exchange compartment, said means connecting said bypass compartment to said heat exchange compartment comprising an opening formed in said partition.

4. The system of claim 1 further comprising a vertical wall which, together with the rear wall and sidewalls of said furnace section, define said housing.

5. The system of claim 4 wherein said means for connecting said bypass compartment and said heat exchange compartment to said furnace section comprises openings formed in said rear wall of said furnace section.

6. The system of claim 1 wherein said air introducing means comprises an air plenum extending below said housing for receiving fluidizing air, and an air distributor extending above said air plenum for supporting said air nozzles and said separated particulate material.

7. The system of claim 1 wherein said heat exchange means comprises water tubes disposed in said heat exchange compartment for passing a fluid in a heat exchange relation to the separated particulate material in said heat exchange compartment to heat said fluid and control the temperature of the separated particulate material.

8. A fluidized bed combustion method comprising the steps of fluidizing a bed of combustible material in a furnace section, discharging a mixture of flue gases and entrained material from said furnace section, separating said entrained material from said flue gases, passing said separated flue gases to a heat recovery section, passing said separated material directly into a bypass chamber, introducing air to said bypass chamber at different locations to selectively pass said separated material from said bypass chamber to said furnace section or to a heat exchange chamber, and removing heat from said separated material in said heat exchange chamber.

9. The method of claim 8 further comprising the step of introducing air to said heat exchange chamber to pass said separated material from said heat exchange chamber to said furnace section.

10. The method of claim 9 wherein said air fluidizes said separated material in said bypass chamber and said heat exchange chamber.

11. The method of claim 8 wherein air is introduced to said bypass chamber at a first height to pass said separated material from said bypass chamber to said heat exchange chamber, and at a second height to pass said separated material from said bypass chamber to said furnace section.

12. The method of claim 8 further comprising the step of establishing a fluid flow circuit including said heat exchange chamber and water tubes forming at least a portion of the walls of said furnace section, said step of removing comprising the step of passing fluid through said circuit.

* * * * *